United States Patent [19]

Burdett

[11] Patent Number: 4,915,346

[45] Date of Patent: Apr. 10, 1990

[54] SPACERS FOR USE IN FORMING MODULAR BUILDINGS

[76] Inventor: Harold D. Burdett, P.O. Box 30549, Mesa, Ariz. 85275

[21] Appl. No.: 292,840

[22] Filed: Jan. 3, 1989

[51] Int. Cl.[4] ..... E04G 17/06

[52] U.S. Cl. ..... 249/91; 52/677; 249/42; 249/43; 249/83; 249/177; 249/188; 249/217; 249/219.1

[58] Field of Search ..... 249/42, 43, 83, 91, 249/177, 216, 217, 219.1, 39, 188; 52/677, 685, 686

[56] References Cited

U.S. PATENT DOCUMENTS

| | | | |
|---|---|---|---|
| 1,781,601 | 11/1930 | Rohaut et al. | 249/217 |
| 2,099,260 | 11/1937 | Colt | 249/216 |
| 2,502,672 | 4/1950 | Roother | 249/42 |
| 3,168,772 | 2/1965 | Williams | 249/217 |
| 3,479,785 | 11/1969 | Asch | 52/701 |
| 3,993,720 | 11/1976 | Burdett | 264/33 |
| 4,029,287 | 6/1977 | Burdett | 249/27 |
| 4,667,923 | 5/1987 | Lee | 249/42 |

FOREIGN PATENT DOCUMENTS

| | | | |
|---|---|---|---|
| 2408558 | 8/1975 | Fed. Rep. of Germany | 249/217 |
| 2434333 | 1/1976 | Fed. Rep. of Germany | 52/677 |
| 144519 | 3/1931 | Switzerland | 249/42 |

*Primary Examiner*—James C. Housel

*Attorney, Agent, or Firm*—Warren F. B. Lindsley

[57] ABSTRACT

A conical spacer assembly for supporting and spacing one member relative to another member comprising a conical housing having a smooth outer surface and hole extending axially therethrough for receiving at one or both ends thereof a bolt in threaded arrangement therewith. A flat circular shaped clamp having an aperture extending laterally therethrough is provided for receiving through its aperture the housing of the spacer which clamp snugly engages the housing at a point along its length laterally thereof and engages and supports a rebar at one or more point around its periphery.

4 Claims, 2 Drawing Sheets

SPACERS FOR USE IN FORMING MODULAR BUILDINGS

BACKGROUND OF THE INVENTION

This invention relates to portable apparatus for forming reinforced concrete, hollow core units of a modular building structure, and more particularly to conical spacers used for supporting and spacing supplemental forms in parallel relationship to primary forms of a core unit and for providing locating holes when removed for vertical alignment of the core unit for casting multi-storied structures.

DESCRIPTION OF THE PRIOR ART

U.S. Pat. Nos. 3,993,720 and 4,029,287 disclose apparatus for forming modular building structure with both patents disclosing nonremovable conical spacers adapted to support and space vertical steel plates of supplemental forms in parallel relationship the required distance from the vertical steel plates of the primary form. Since these nonremovable conical spacers can only serve a single given function, a need exists for removable conical spacers that not only can be used again but the hole from which they have been removed can also serve as a means for later form alignment purposes.

SUMMARY OF THE INVENTION

In accordance with the invention claimed, an improved spacer is provided for use in forming hollow core modular building structures of single or multi-story construction.

It is, therefore, one object of this invention to provide an improved conical shaped spacer for use in forming modular building structures.

Another object of this invention is to provide an improved conical spacer for spacing form components and when cast in concrete decks may be removed to provide alignment holes for sequential multi-storied form use.

A further object of this invention is to provide an improved apparatus for forming modular building structures which employs removable conical spacers used for spacing and alignment purposes.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawing in which.

DESCRIPTION OF THE PREFERRED EMBODIMENT

Figure 1:
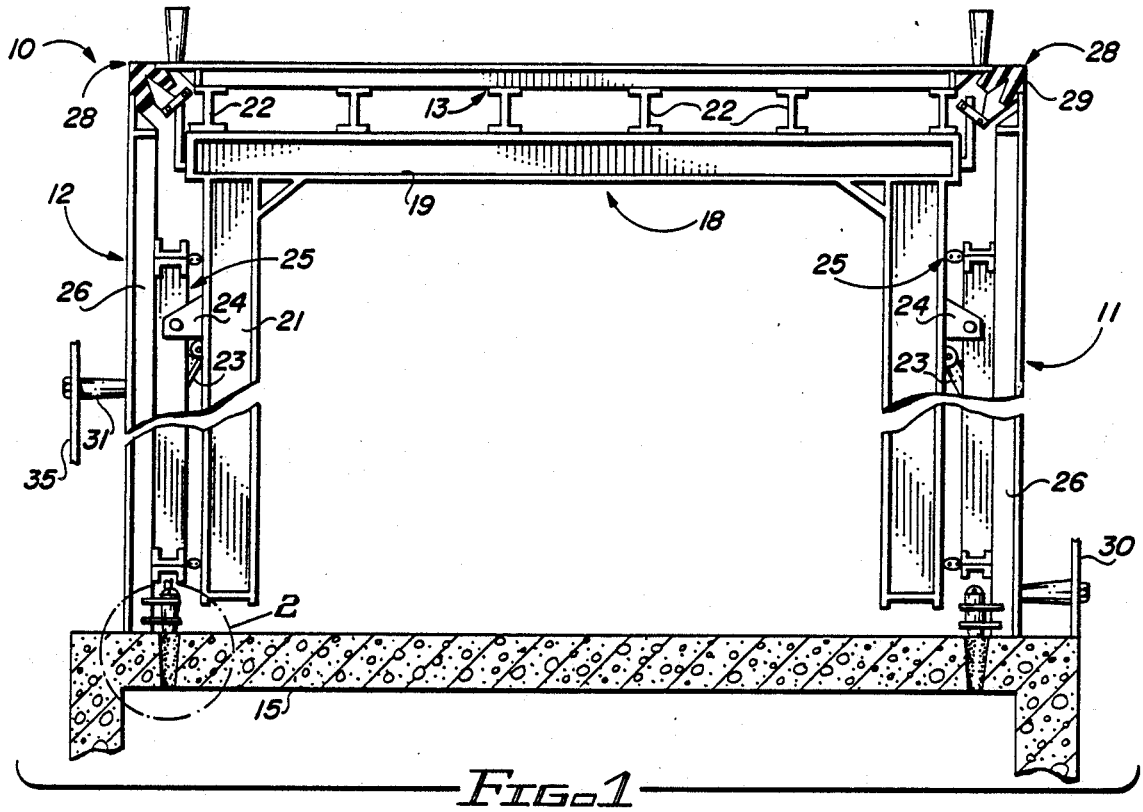
FIG. 1 is a front end elevational view of an assembled inner form or cell structure showing the side wall, ceiling and corner filler components of the device in fully expanded relationship with removable side panels of a supplemental form shown in combination with the novel conical spacers disclosed and claimed herein.

Referring more particularly to the drawings by characters of reference, FIG. 1 discloses an assembled inner form or cell structure 10 for use in precasting hollow core construction comprising right and left side wall assemblies or frames 11 and 12, respectively, and a top or ceiling assembly 13.

It should be noted that the inner form of cell structure 10 is capable of being utilized to produce a plurality of single story interconnected hollow core concrete units in side by side relationship or a plurality of similar units in high rise relationship of two or more storied structures. Therefore, when the cell structure is being set up to produce the first story of a multiple unit structure, the side walls 11 and 12 of the forms are allowed to rest on the level inner top surfaces of the previously prepared concrete footings or on a floor or ground surface as indicated in FIG. 1 of the drawings. When being set up to produce a second and subsequent stories of the structure, the side walls 11 and 12 are supported a slight distance above the level surfaces of the floor/ceiling portion of the finished hollow core unit directly below as described in U.S. Pat. No. 4,029,287 which is incorporated herein by reference.

Each cell structure 10 includes two or more bridge like heavily constructed steel inner frame members 18, the quantity depending on the overall length of the cell structure and each inner frame consists of a horizontal tie beam 19 and a pair of depending side members 20 and 21. The frame member is preferably fabricated of standard I-Beam steel stock which is welded to form a perfectly squared contiguous form which is installed in the interior of cell structure 10 in spaced parallel relationship to the side wall assemblies 11 and 12 and the top or ceiling assembly 13. This frame member is arranged to move or reciprocate vertically with assemblies 11, 12 and 13 to which it is rigidly secured by longitudinally disposed parallel I-beams 22. These I-beams 22 extend between the inner surface of the ceiling assembly over and beyond the horizontal top surfaces of the bridge like inner frame members 18. The depending vertical side members 20 and 21 are movably associated with the side wall assemblies 11 and 12 by pairs of hydraulic cylinders 23, pairs of outwardly extending angle brackets 24 having removable pins, and pairs of pivoting link and bracket assemblies 25.

The side wall assemblies 11 and 12 and the top or ceiling assemblies 13 are preferably fabricated of heavy gauge steel plates that are perfectly flat and smooth on their outer surfaces having welded thereto on their inner surfaces a plurality of equally spaced, parallel vertical or horizontally disposed reinforcing ribs 26. The ceiling plate is just wide enough to extend beyond the ends of the horizontal ribs 27 to provide an equal right angle opening or vacated space 28 which extends the full length of the inner form or cell 10 when the same is in either its fully expanded or contracted position to allow for the manual insertion or removal of the longitudinal segments of suitable split, flexible, corner filler pieces 29 into or out of the right angle openings 28. The filler pieces are provided to square off and close the corner openings in preparation for the forming of a hollow core concrete unit and to allow for removal of the inner form or cell from the formed unit when the concrete is set.

Reference is made to the description in U.S. Pat. No. 4,029,287 for a more detailed description of cell structure 10 and its function.

When the building project calls for the construction of single or multiple width side by side hollow core concrete units of either one or several stories high, the inner form or cell structure 10 is set up or installed so that the opposed smooth outer surfaces of the side plates of the side wall assemblies 11 and 12 are spaced apart the required distance. In order to form the outside vertical side walls of the cell, it is necessary to utilize supplement frame members or forms of any suitable type having smooth surfaced vertically mounted steel plates 30 (indicated in FIG. 11). These plates are temporarily attached to side wall plates 11 and 12 by means of removable bolts or studs which are threaded through the respective vertical plates from both sides thereof into the threaded bores of a plurality of removable conical spacers 31 embodying the invention. These spacers are adapted to support and space the vertical steel plates 30 of the supplemental forms in parallel relationship the required distance from the vertical steel plates 11 and 12.

When the particular hollow core concrete units of the building structure are cured, these forms can quickly be removed from their described attachment to side plates 11 and 12 of the side wall assemblies of the cell structure by simply removing the bolts or studs from the plates and conical spacers 31. Spacer 31 are then removed from the finished concrete walls for reuse.

The inner form or cell structure 10 may be utilized to form the hollow core units of a high rise or several storied building structure and the difficult task of setting up or installing the cell structures on the top surface of the finished floor/ceiling portion 15 of the concrete units in proper aligned and spaced relationship for forming the next story of the building structure has been simplified by the utilization of spacers 31.

Figure 2:
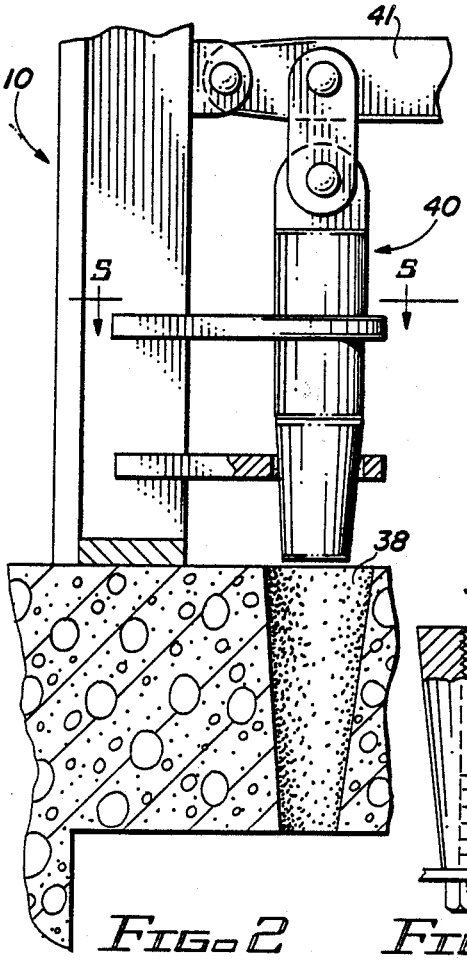
FIG. 2 is a partial sectional view of a conical tapered hole in a precast deck formed by use of the claimed spacer used as a location means for a plunger of a cell structure for alignment purposes.
Figure 2A:
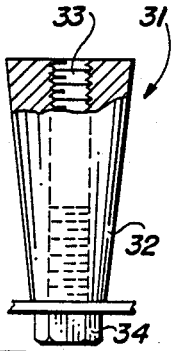
FIG. 2A is a sectional view showing how the conical spacer is held in place in the form prior to casting the deck shown in FIGS. 1 and 2.
Figure 6:
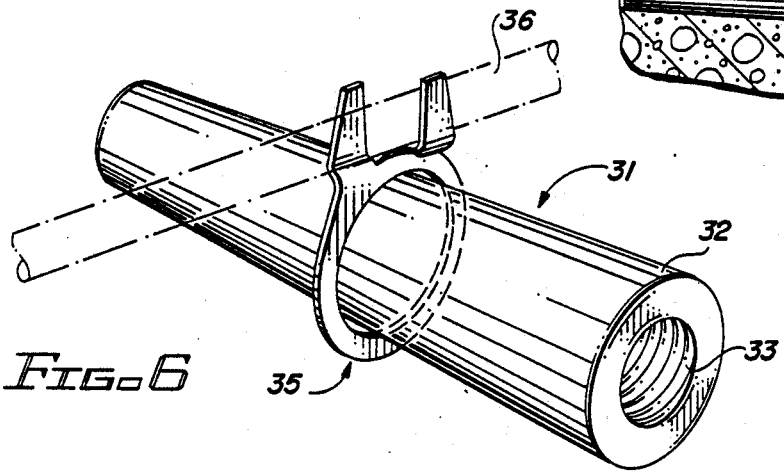
FIG. 6 is a perspective view of a spacer and guide frame supporting a rebar.

The conical spacer 31, as shown in FIGS. 2A and 6, comprises an elongated plastic or metallic conical housing 32 having a smooth outer surface and a threaded aperture 33 extending axially therethrough or at least a part thereof for receiving a threaded bolt 34 at either or both ends thereof.

This spacer is then used, as shown in FIG. 1, for spacing and supporting the vertical steel plates 30 of the supplemental forms to the wall assemblies of the cell structure by bolts 34 extending through apertures in the supplemental form and the steel plates and into the spacers for holding them in a predetermined position between the supplemental form and the cell structure.

Figure 5:
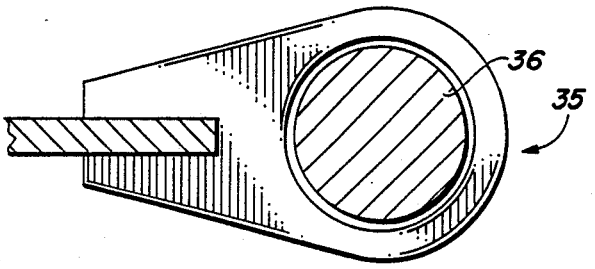
FIG. 5 is a cross sectional view of plunger and one of its guiding frames.
Figure 7:
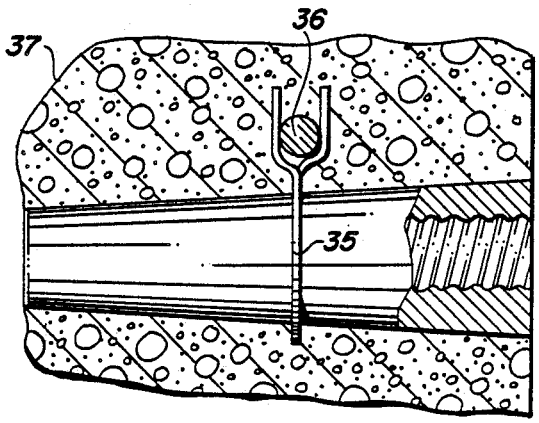
FIG. 7 is a view partially in section of a spacer support frame and rebar in cast concrete.

To aid in holding rebars in place between the supplemental forms and the steel plates 11 and 12 an apertured circular shaped clamp 35 may be secured to rebars 36 and the conical spacer. As shown in FIGS. 5–7, housing 32 of spacer 31 is longitudinally moved through the aperture in the clamp until a snug fit occurs at a given point along its length, thereby holding the rebar in the center of the gap between the supplemental form and members 11 and 12 during a concrete pouring operation. Depending on the size of the aperture of clamp 35, the rebar may be placed at various places in the poured concrete.

Figure 8:
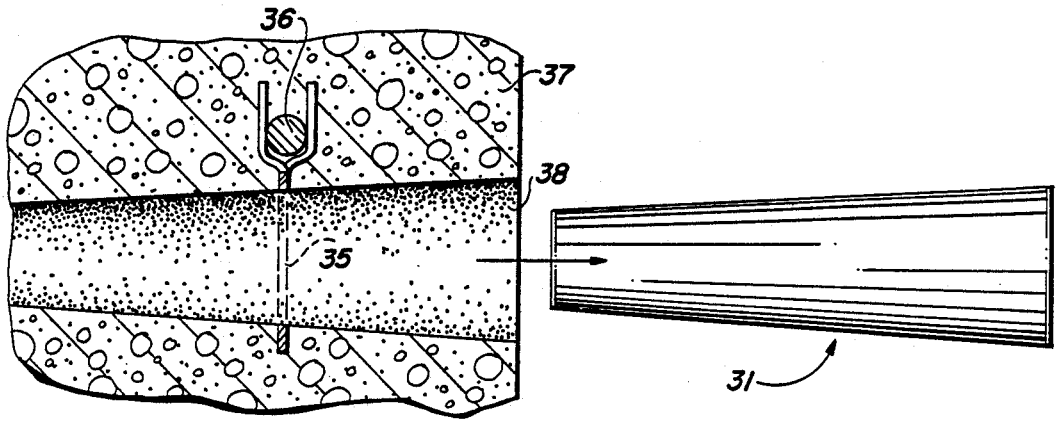
FIG. 8 is a view showing the spacer being removed from its position shown in FIG. 7 to provide an alignment hole.

After concrete 37 is poured and set the spacer is removed, as shown in FIG. 8, since it is no longer needed to hold in position the rebar.

If the building structure is to be two or more stories high, spacer 31 is used to provide form alignment holes 38 in the ceiling of the first and/or any story of the multi-story building. To accomplish this function the conical spacers are positioned in a ceiling of the module of the building in the same manner as disclosed above with the spacer tapering downwardly, as shown in FIGS. 2 and 2A.

Then after removal of the spacer by the removal of the spacer bolt 34, the housing is withdrawn upwardly leaving a tapering hole 38 in the ceiling of the building.

In order to receive and position the inner form or cell structure 10 in parallel alignment, above the top floor/-ceiling 15 of the finished lower structure, the above described tapered holes 38 are used by parts of the cell form mounted above the ceiling of the lower structure for alignment purposes.

Figure 3:
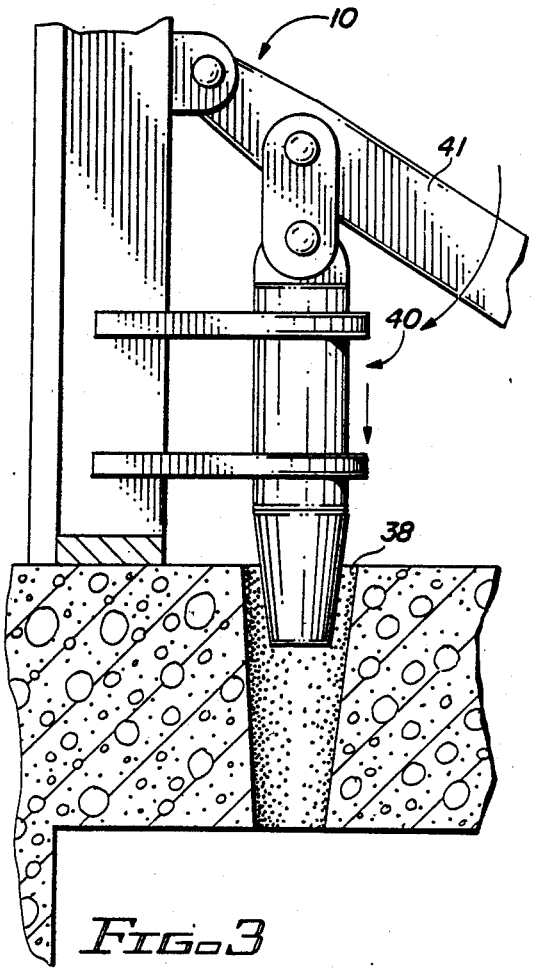
FIG. 3 is a view similar to FIG. 2 showing the plunger of the form assembly penetrating the hole formed by the spacer previously removed.
Figure 4:
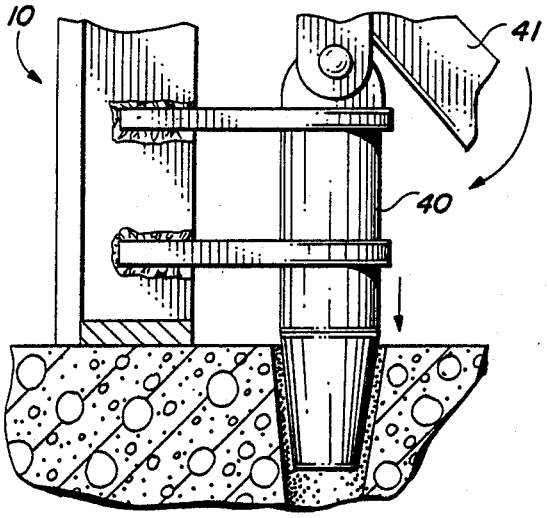
FIG. 4 is a view similar to FIG. 3 with the plunger fully in place in the taper hole previously formed by the spacer disclosed herein.

As shown in FIGS. 2–4, an alignment plunger 40 of the form forming a part of cell structure 10 is mounted above holes 38 and is reciprocally moved into holes 38 by its handle 41 for form aligning purposes and is sequentially moved out of these holes later when the concrete of the newly poured upper story has set.

Although but one embodiment of the invention has been shown and described, it will be apparent to those skilled in the art that various changes and modifications may be made therein without departing from the spirit of the invention or from the scope of the appended claims.

What is claimed is:

1. An assembly for supporting and spacing a supplemental form from a primary form, said assembly comprising a conically shaped housing having a hole extending axially therethrough, at least a part of said hole being threaded for receiving a threaded bolt in either end thereof, and a flat circular shaped clamp having an aperture extending laterally therethrough, said aperture having a diameter slightly larger than an outside diameter of said housing at a point between opposite ends of said housing said clamp snugly engaging said housing at said point when said housing is inserted into said aperture, and means on said clamp for securing said clamp to a rebar, said means comprising a pair of fingers extending laterally of the periphery of said clamp in a common direction.

2. The assembly set forth in claim 1 wherein:

said aperture has a diameter slightly larger than the outside diameter of said housing at a point substantially midway between said opposite ends, and said clamp snugly engaging said housing at said midway point.

3. The assembly set forth in claim 1 wherein:

said fingers are spaced from each other for receiving therebetween said rebar.

4. The assembly set forth in claim 1 wherein:

said fingers are formed integral with said clamp.

* * * * *

UNITED STATES PATENT OFFICE

CERTIFICATE OF CORRECTION

Patent No. 4,915,346 Dated April 10, 1990

Inventor(s) Harold D. Burdett

It is certified that error appears in the above-identified patent and that said Letters Patent is hereby corrected as shown below:

Claim 1, line 11 - after "housing" insert ---,---.

Signed and Sealed this

Ninth Day of July, 1991

*Attest:*

HARRY F. MANBECK, JR.

*Attesting Officer*

*Commissioner of Patents and Trademarks*